US005810026A

United States Patent [19]

Sham

[11] Patent Number: 5,810,026

[45] Date of Patent: Sep. 22, 1998

[54] ELECTRIC HAIR-CURLING APPARATUS

[75] Inventor: John C. K. Sham, Hong Kong, Hong Kong

[73] Assignee: Pentalpha Enterprises Ltd., Aberdeen, Hong Kong

[21] Appl. No.: 753,836

[22] Filed: Dec. 2, 1996

Related U.S. Application Data

[60] Provisional application No. 60/023,627.

[51] Int. Cl. [6] ..... A45D 1/04

[52] U.S. Cl. ..... 132/232; 132/236

[58] Field of Search ..... 132/232, 229, 132/231, 234, 269, 224; 219/225, 226, 222

[56] References Cited

U.S. PATENT DOCUMENTS

| | | | |
|---|---|---|---|
| 1,999,898 | 4/1935 | Fitzgerald | 132/232 |
| 2,954,788 | 10/1960 | Madore | 219/222 |
| 3,472,245 | 10/1969 | Abe | 219/222 |
| 3,516,420 | 6/1970 | Porter | 219/225 |
| 3,660,634 | 5/1972 | Scott | 219/222 |
| 4,365,140 | 12/1982 | Bast et al. | 132/232 |
| 4,866,249 | 9/1989 | Howard | 132/231 |
| 5,046,516 | 9/1991 | Barradas | 132/232 |

FOREIGN PATENT DOCUMENTS

| | | | |
|---|---|---|---|
| 548592 | 1/1923 | France | 132/224 |

*Primary Examiner*—Todd E. Manahan
*Attorney, Agent, or Firm*—Salzman & Levy

[57] ABSTRACT

The present invention features an electric, hair-curling apparatus. The hair curler is designed to prevent the heated wand from coming into unwanted contact with other surfaces and parts of the body. Its purpose is to prevent accidental injuries or burns to the body surfaces of a user or to furniture, etc. The electric hair-curler is fabricated having many insulative ribs that are periodically spaced apart and located along a longitudinal axis of the wand. These ribs are operative in shielding the heated surface of the wand from contact with unwanted surfaces, including parts of the user's body. Having a sinusoidally-shaped or undulating periphery, the ribs allow hair to easily flow into the interstitial wells between the ribs; hair flowing into the wells is free to contact the wand surface. The ribs are also designed with a wide, circumferential portion that is positioned substantially flush with the wand surface at the section of contact with the clamp. At that wand contact position with the clamp, the ribs present an open, or a completely flush, position. This creates a restriction-free area or surface in which hair can enter and be withdrawn from the clamp, without interference or inhibition from the ribs.

17 Claims, 5 Drawing Sheets

ELECTRIC HAIR-CURLING APPARATUS

This application claims the benefit of U.S. Provisional application Ser. No.: 60/023,627 filed Aug. 9, 1996.

FIELD OF THE INVENTION

The present invention pertains to electric, hair-curling irons and, more particularly, to an electric, hair-curling iron that has spaced-apart, sinusoidally-shaped, solid ribs along the major axis of the longitudinal heating-wand, in order to prevent heated contact with body parts other than hair, thus avoiding occasional, serious burns.

BACKGROUND OF THE INVENTION

The electric, hair-curling iron has become a ubiquitous household appliance. In many households, there are several such curling appliances, one for each female (and often more than one, for special purposes such as travel, quick touch-ups and overnights).

Most, if not all, of the commercially-popular curling irons feature a smooth-surface heating wand, which is overlaid with a spring-biased clamp. Below the clamp on the wand is the handle of the apparatus. The operative methodology of the curling procedure is to wrap the hair about the heated wand, while the spring-biased clamp is held extended therefrom. The clamp is held in the extended position against a spring force that biases the clamp toward contact with the smooth wand.

After wrapping the hair several times about the heated wand, the spring-biased clamp is closed, and the heat from the wand is allowed to permeate through the hair for as long as the user wishes, usually not more than a minute or so. Upon opening or release of the clamp, the hair is allowed to unwind from the wand, resulting in a curled lock of hair.

It is occasionally annoying, and sometimes dangerous, when the heated surface of the wand comes into contact with objects other than the hair, such as countertops and parts of the user's body. When in contact with the body, the heating wand has been known to cause severe burns. A cradling stand is usually provided about the mid-portion of the wand to allow for interruptions, as well as warm-ups. However, this stand is usually made of flimsy wire, with the wand being easily dislodged therefrom.

Several years ago, a safety wand was proposed, in which the wand was covered by periodically-spaced, annular ribs. Anchored to the mortised wand by t-shaped spokes, these annular ribs had a trapezoidal opening, so as to accommodate the passage of the clamp toward the wand surface. Such a safety wand is illustrated in U.S. Pat. No. 4,866,249 (issued to HOWARD on Sep. 12, 1989), entitled "Safety Device for Hair Curling Heating Irons to Prevent Burns". The intention of the annular, spaced-apart ribs was to have them act as heat-insulative spacers between the heated wand and any other bodies; thus, accidental contact with the heated wand was prevented. The annular spacers did not interfere or inhibit the normal operation of the curling iron. The hair was able to fall between these heat-insulative spacers to the heated-wand surface, so that the curling iron could be operative for its intended purpose. Any and all other surfaces were thus held at an extended distance by the ribs.

In theory, the operation of this device would work to prevent objects other than the hair from contacting the wand. In practice, however, the hair often became snagged between the extension spokes of the ribs anchoring them to the heated wand. One does not need to explain the inconvenience and difficulty of trying to extricate snagged hair from a heated curling iron. More often than not, users became burned and injured by the structure that was originally designed to prevent such harm!

The present inventor has determined that the theory of employing the annular ribs was sound, but the execution was faulty. Since hair is free-flowing, it wanders into small crevices and openings; therefore, spoke-like ribs provide just such spaces wherein the hair can become entangled. The present invention reflects the discovery that the annular, insulative ribs should be solid and shaped with a low profile with respect to the wand surface, so that snagging is greatly minimized.

The ribs of this invention have been made to be flush with the clamp contact position. The flush rib surface at the clamping point presents minimal interference with the entrapped hair within the clamp. Further, the ribs have been designed so as to have a sinusoidally-shaped, or undulating, peripheral surface that allows the hair to flow down between the ribs. The sinusoidally-shaped wells on the circumferential surface of each rib, presents a surface that yields to the hair elements, and allows them to flow down between the interstices between the ribs.

It is an object of this invention to provide an improved, electric, hair-curling apparatus.

It is another object of the invention to provide a safer, electric, hair-curling apparatus, one that is designed to protect the user against unwanted contact with a heated-wand surface.

SUMMARY OF THE INVENTION

In accordance with the present invention, there is provided an electric, hair-curling apparatus. The hair curler is designed to prevent the heated wand from coming into unwanted contact with other surfaces and parts of the body. Its purpose is to prevent accidental injuries or burns to the body surfaces of a user or to furniture, etc. The electric hair-curler is fabricated having a plurality of periodically spaced-apart, insulative ribs disposed along a longitudinal axis of the wand. These ribs are operative in shielding the heated surface of the wand from contact with unwanted surfaces, including parts of the user's body. Having a sinusoidally-shaped or undulating periphery, the ribs allows hair to easily flow into the interstitial wells therebetween; hair flowing into the wells is free to contact the wand surface. The ribs are also designed with a wide, circumferential portion that is disposed substantially flush with the wand surface at the section of contact with the clamp. At that wand contact position with the clamp, the ribs present an open, or a completely flush, position. Thus, there is created a restriction-free area or surface wherein hair can enter and be withdrawn from the clamp, without interference or inhibition from the ribs themselves.

BRIEF DESCRIPTION OF THE DRAWINGS

A complete understanding of the present invention may be obtained by reference to the accompanying drawings, when taken in conjunction with the subsequent, detailed description, in which.

For purposes of clarity and brevity, like elements and components will bear the same designations and numbers throughout the FIGURES.

DESCRIPTION OF THE PREFERRED EMBODIMENT

Generally speaking, the invention features a safe, hair-curling iron. The curling iron has spaced-apart, insulative ribs disposed along the longitudinal axis of the heating wand. The ribs present a configuration that prevents the heated part of the wand from coming into contact with any surfaces of the user's body, while still allowing the hair to fall in the wells between the ribs, where it will contact the heated wand, as it does in the normal operation of other such wands. The hair is wound about the heated wand as is conventionally done with smooth-surfaced, curling irons. The clamp of the curling iron is then disposed over the hair, pinning the hair about the heated wand, so that a curl can be imparted to the hair.

Figure 1:
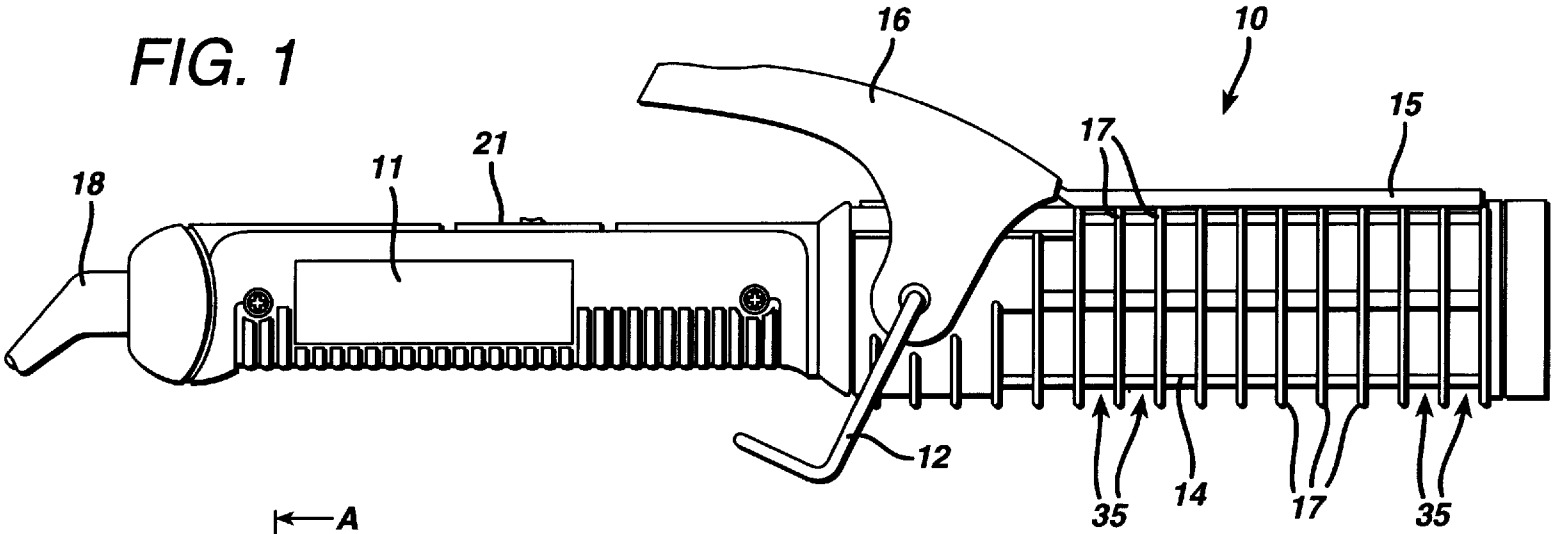
FIG. 1 illustrates a side view of a curling wand of this invention.
Figure 2:
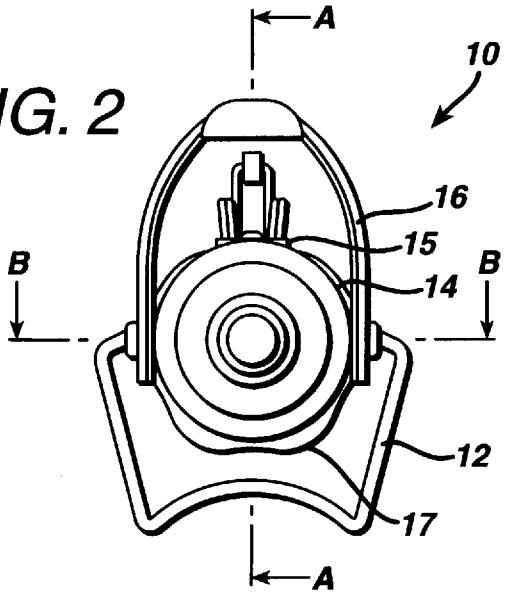
FIG. 2 depicts a front view of the curling wand shown in FIG. 1.

Now referring to FIGS. 1 and 2, the curling iron 10 of this invention is illustrated. As conventional with most curling irons, the curling iron 10 comprises a handle 11 for gripping, a resting stand 12, a heating wand 14, a hair clamp 15 and a clamp lever 16. The difference between the curling iron 10 of this invention and that of conventional curling irons is represented by the spaced-apart ribs 17, disposed along the longitudinal axis of the heating wand 14. The spaced-apart ribs 17 prevent the heated wand 14 from coming into contact with surfaces of the body other than the hair to be curled, as will be explained in greater detail hereinafter.

Figure 3:
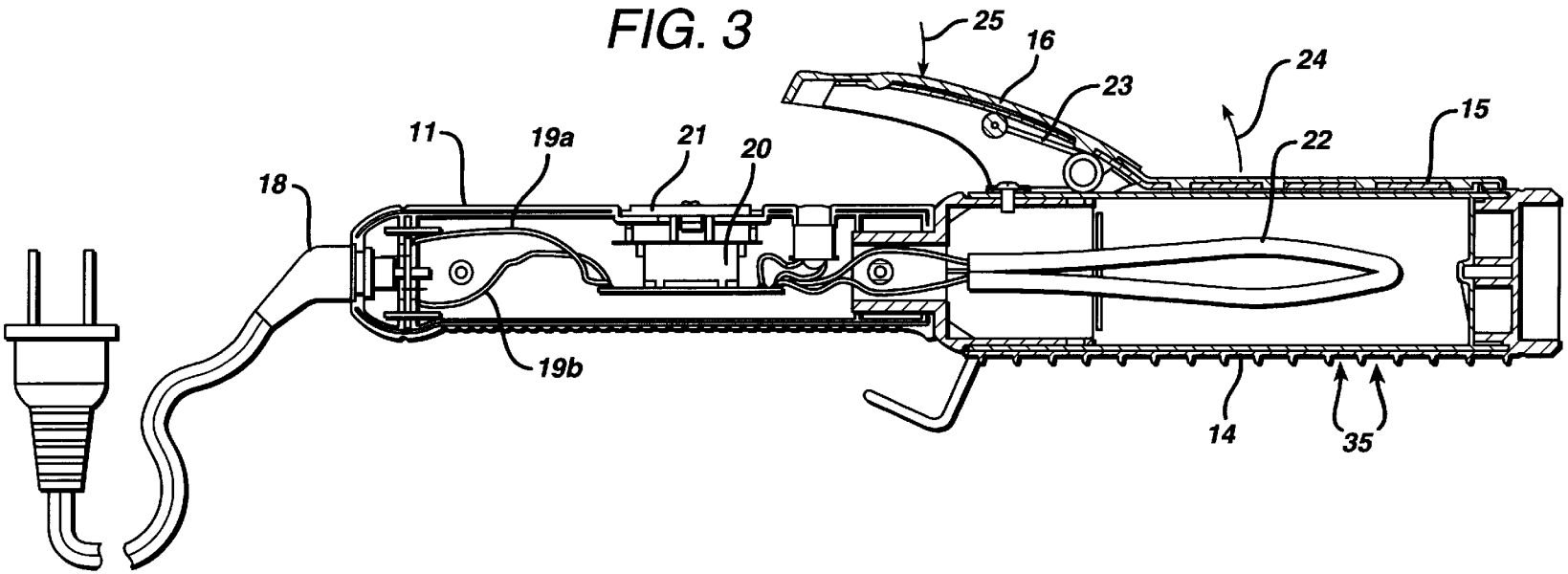
FIG. 3 shows a sectional view of the curling wand depicted in FIG. 2, taken along lines A—A.

Referring to FIG. 3, a sectional view of the curling iron 10 is shown. A power cord 18 is disposed on the distal end of the handle 11. The wires 19*a* and 19*b* of the cord are connected to a switch 20 that is actuated by a slide button 21 on the top of the handle 11. When the slide button 21 is pushed to actuate the switch 20, power is supplied to the heating coil 22, as is accomplished in the conventional manner.

The hair clamp 15 is lifted (arrow 24) from the heating wand 14 by depressing (arrow 25) the conventional, clamp lever 16 against the spring-biasing provided by the coil spring 23, as is commonly known in the art.

Figure 4:
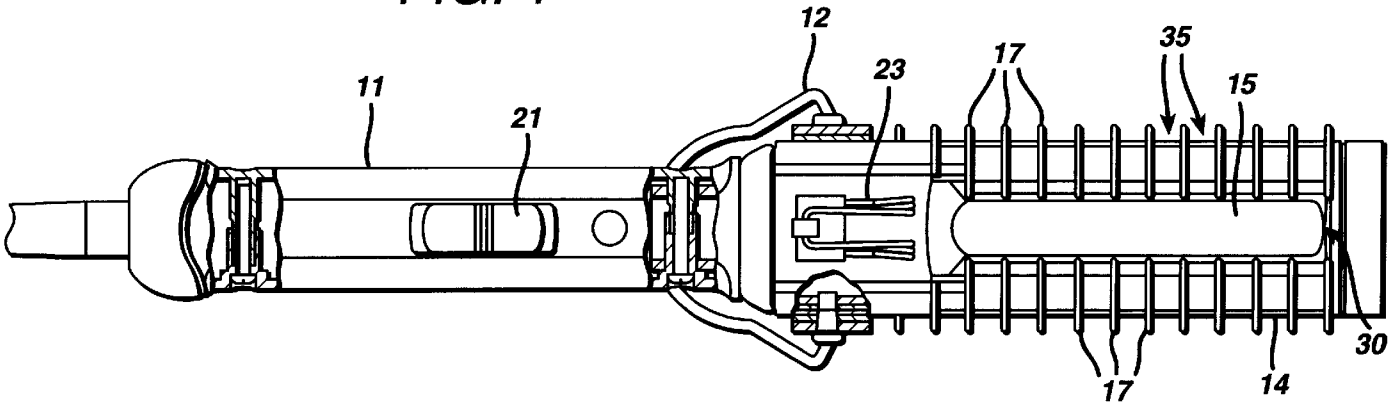
FIG. 4 illustrates a sectional view of the curling wand depicted in FIG. 2, taken along lines B—B.

The hair clamp 15 rests between the open spaces of the ribs 17, as is shown clearly in the sectional top view of FIG. 4. The open, top spaces in the ribs 17 allow the clamp 15 to reach the heated wand 14, thus entrapping the curled hair thereupon.

Figure 5:
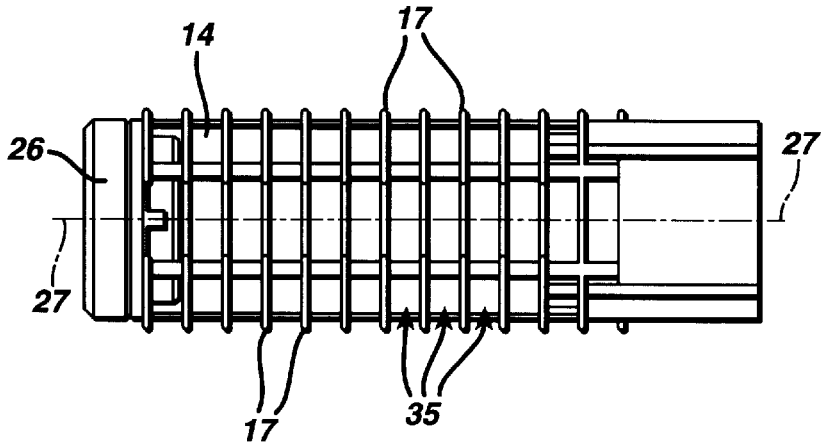
FIG. 5 depicts a top view of the heated-wand portion of the curling apparatus shown in FIG. 1.
Figure 6:
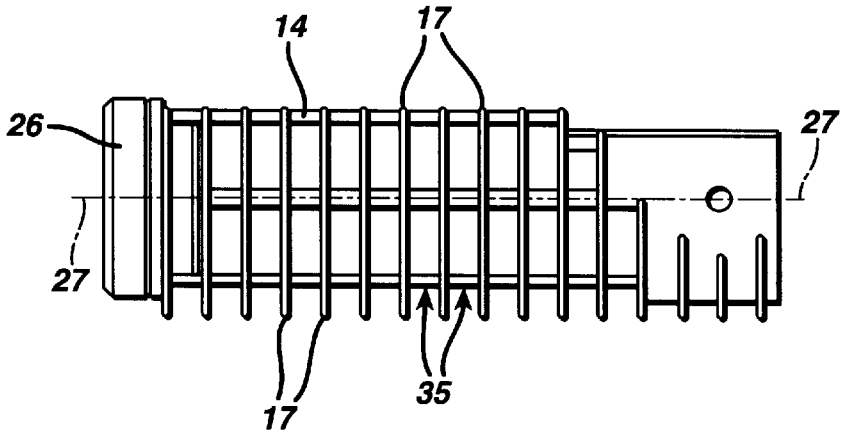
FIG. 6 shows a side view of the heated-wand portion of the curling apparatus shown in FIG. 1.
Figure 7:
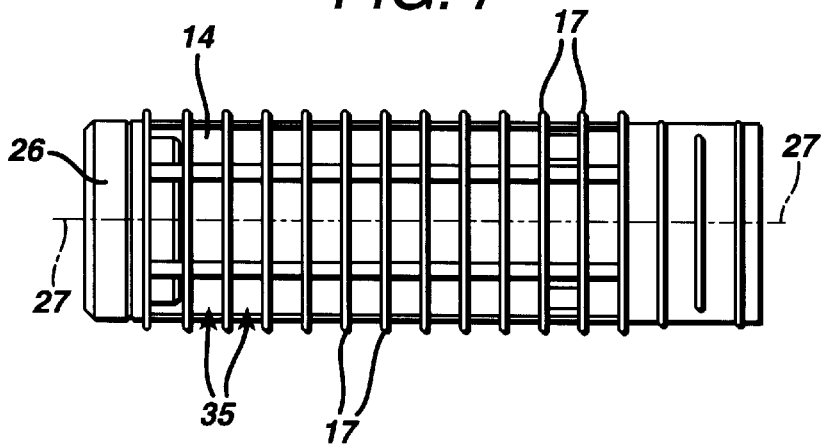
FIG. 7 illustrates a bottom view of the heated-wand portion of the curling apparatus shown in FIG. 1.
Figure 8:
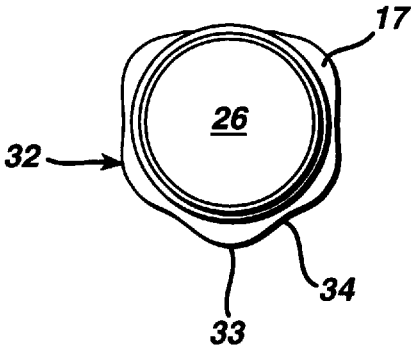
FIG. 8 depicts an end view of FIG. 6.
Figure 9:
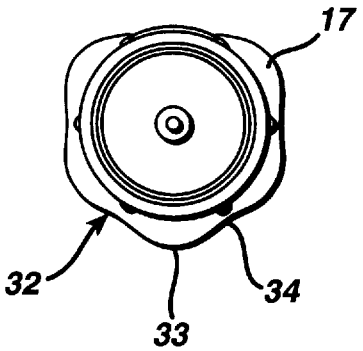
FIG. 9 shows a sectional view of FIG. 6, taken along lines A—A.
Figure 10:
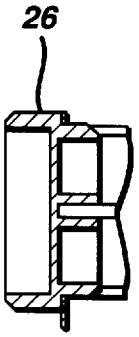
FIG. 10 illustrates a sectional view of FIG. 6, taken along lines B—B.
Figure 11:
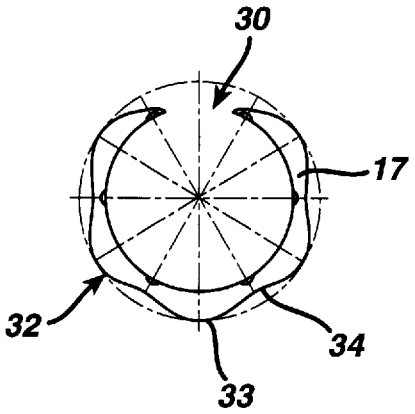
FIG. 11 depicts a sectional view of FIG. 6, taken along lines C—C.
Figure 12:
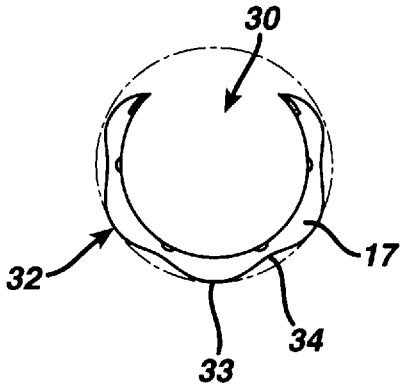
FIG. 12 shows a sectional view of FIG. 6, taken along lines D—D.
Figure 13:
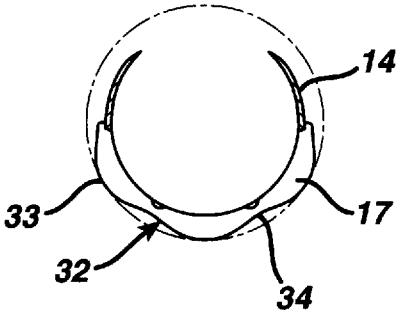
FIG. 13 illustrates a sectional view of FIG. 6, taken along lines E—E.
Figure 14:
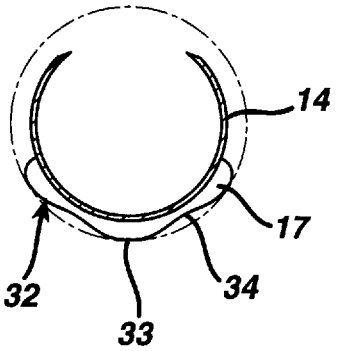
FIG. 14 depicts a sectional view of FIG. 6, taken along lines F—F.
Figure 15:
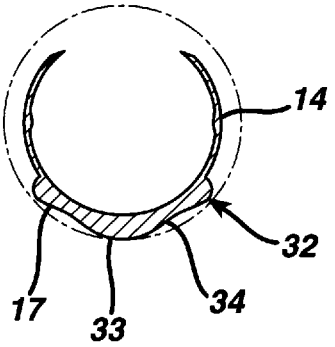
FIG. 15 shows a sectional view of FIG. 6, taken along lines G—G.

Referring to FIGS. 5 through 7 (depicting top, side and bottom views, respectively), the wand portion 14 of the curling iron 10 is shown in more detail. The wand 14 comprises an insulative end cap 26, shown in sectional detail in FIG. 10. The ribs 17 are shown periodically spaced apart along the longitudinal axis 27 of the wand 14. The ribs 17 comprise polycarbonate material, which provides good, thermal insulation from the heated wand 14. As is well known in the art, other, thermally-insulative plastics can also be used.

Referring to FIGS. 8, 9 and 11–15, the end and sectional views of the ribs 17 are shown in detail. The ribs 17 provide an open space 30 at the top of the wand 14 for placement of the clamp 15. The ribs 17 comprise a sinusoidally-shaped type of undulant periphery 32. The peak areas 33 of the periphery project beyond the surface of the heated wand 14, therefore protecting against contact therewith. The valleys 34 of the ribs 17 allow the hair to slip into the wells 35, which are defined by the longitudinal spaces disposed between the ribs 17 (as shown in FIGS. 1 and 3–7). The strands of the hair can easily slip off the ribs 17 and down into the wells 35, thus contacting the heated surface of the wand 14, where they can be wound thereupon to form a curl. The clamp 15, which has been extended upward (arrow 24, FIG. 3), can then be released against its biasing to hold the hair in place, while the hair strands absorb the heat from wand 14 and form a curl. The valleys 34 of the ribs 17 are almost flush with the surface of the wand 14. The peaks 33 at the top of the wand 14 slope downwardly to the surface of the wand 14, forming an opening 30 for the clamp 15. This allows for the free flow of hair into contact with the wand 14.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. A curling iron, comprising:

a handle for holding said curling iron;

a heating wand supported by said handle, and having a longitudinal axis;

a movable clamp disposed adjacent said heating wand for holding wrapped strands of hair against a surface portion thereof, said clamp being movable between an extended position away from said heating wand and a contact position adjacent said heating wand;

biasing means supported by said heating wand for biasing said movable clamp towards said contact position;

a lever connected to said movable clamp for moving it against its biasing to its extended position, and for releasing it to its contact position; and a plurality of spaced-apart ribs disposed along said longitudinal axis of said heating wand, defining wells disposed along a contact surface thereof and therebetween, with each of said spaced-apart ribs being substantially solid and comprising a curved, peripheral surface, so as to allow strands of hair to flow into said wells in order to contact said heated wand when said clamp is in its extended position, and wherein a portion of said curved peripheral surface of each of said plurality of spaced-apart ribs has a flush portion that slopes toward said contact surface, and is substantially flush therewith.

2. The curling iron in accordance with claim 1, wherein the curved, peripheral surface of each of said spaced-apart ribs is undulant.

3. The curling iron in accordance with claim 1, wherein said spaced-apart ribs are spaced periodically with respect to each other.

4. The curling iron in accordance with claim 1, wherein each of said spaced-apart ribs comprises thermally insulative material.

5. The curling iron in accordance with claim 4, wherein said thermally insulative material comprises polycarbonate.

6. A curling iron, comprising:

a handle for holding said curling iron;

a heating wand supported by said handle, and having a longitudinal axis;

a movable clamp disposed adjacent said heating wand for holding wrapped strands of hair against a surface portion thereof, said clamp being movable between an extended position away from said heating wand and a contact position adjacent said heating wand;

biasing means supported by said heating wand for biasing said movable clamp towards said contact position;

a lever connected to said movable clamp for moving it against its biasing to its extended position, and for releasing it to its contact position; and a plurality of spaced-apart ribs disposed along said longitudinal axis of said heating wand, defining wells disposed along a contact surface and therebetween, with each of said spaced-apart ribs comprising an undulant, curved, peripheral surface, so as to allow the free flow of strands of hair into said wells, in order to contact said heated wand when said clamp is in its extended position, and wherein a portion of said curved peripheral surface of each of said plurality of spaced-apart ribs has a flush portion that slopes toward said contact surface, and is substantially flush therewith.

7. The curling iron in accordance with claim 6, wherein each of said spaced-apart ribs is substantially solid.

8. The curling iron in accordance with claim 6, wherein said spaced-apart ribs are spaced periodically with respect to each other.

9. The curling iron in accordance with claim 6, wherein each of said spaced-apart ribs comprises thermally insulative material.

10. The curling iron in accordance with claim 9, wherein said thermally insulative material comprises polycarbonate.

11. A curling iron, comprising:

a handle for holding said curling iron;

a heating wand supported by said handle, and having a longitudinal axis;

a movable clamp disposed adjacent said heating wand for holding wrapped strands of hair against a surface portion thereof, said clamp being movable between an extended position away from said heating wand and a contact position adjacent said heating wand;

biasing means supported by said heating wand for biasing said movable clamp towards said contact position;

a lever connected to said movable clamp for moving it against its biasing to its extended position, and for releasing it to its contact position; and a plurality of spaced-apart ribs disposed along said longitudinal axis of said heating wand, defining wells therebetween, with each of said spaced-apart ribs comprising a substantially sinusoidally curved, peripheral surface, so as to allow the free flow of strands of hair into said wells, in order to contact said heated wand when said clamp is in its extended position, and with each of said spaced-apart ribs comprising thermally insulative material.

12. The curling iron in accordance with claim 11, wherein each of said spaced-apart ribs is substantially solid.

13. The curling iron in accordance with claim 11, wherein said spaced-apart ribs are spaced periodically with respect to each other.

14. The curling iron in accordance with claim 11, wherein said thermally insulative material comprises polycarbonate.

15. A curling iron, comprising:

a handle for holding said curling iron;

a heating wand supported by said handle, and having a longitudinal axis;

a movable clamp disposed adjacent said heating wand for holding wrapped strands of hair against a surface portion thereof, said clamp being movable between an extended position away from said heating wand and a contact position adjacent said heating wand;

biasing means supported by said heating wand for biasing said movable clamp towards said contact position;

a lever connected to said movable clamp for moving it against its biasing to its extended position, and for releasing it to its contact position; and a plurality of spaced-apart ribs disposed along said longitudinal axis of said heating wand, defining wells therebetween, with each of said spaced-apart ribs comprising a circumferential portion disposed substantially flush with the wand surface at a section of contact with the clamp, and an undulant, curved, peripheral surface for allowing the free flow of strands of hair into said wells, in order to contact said heated wand when said clamp is in its extended position.

16. The curling iron in accordance with claim 15, wherein each of said spaced-apart ribs is substantially solid.

17. The curling iron in accordance with claim 15, wherein said spaced-apart ribs are spaced periodically with respect to each other.

* * * * *